United States Patent [19]

Tamura

[11] Patent Number: 4,854,124

[45] Date of Patent: Aug. 8, 1989

[54] DOUBLE AIR-FUEL RATIO SENSOR SYSTEM HAVING DIVIDED-SKIP FUNCTION

[75] Inventor: Masanobu Tamura, Toyota, Japan

[73] Assignee: Toyota Jidosha Kabushiki Kaisha, Aichi, Japan

[21] Appl. No.: 216,099

[22] Filed: Jul. 7, 1988

[30] Foreign Application Priority Data

Jul. 10, 1987 [JP] Japan ..... 62-171258

[51] Int. Cl.[4] ..... F02B 75/10; F02D 41/14

[52] U.S. Cl. ..... 60/274; 60/276; 60/285; 123/489

[58] Field of Search ..... 123/440, 489, 589; 60/274, 276, 285

[56] References Cited

U.S. PATENT DOCUMENTS

| | | | |
|---|---|---|---|
| 3,939,654 | 2/1976 | Creps | 60/276 |
| 4,027,477 | 6/1977 | Storey | 60/276 |
| 4,130,095 | 12/1978 | Bowler et al. | 123/440 |
| 4,235,204 | 11/1980 | Rice | 123/440 |
| 4,251,989 | 2/1981 | Norimatsu et al. | 60/276 |
| 4,475,517 | 10/1984 | Kobayashi et al. | 123/489 |
| 4,539,958 | 9/1985 | Ito et al. | 123/440 |
| 4,561,400 | 12/1985 | Hattori | 123/478 |
| 4,571,683 | 2/1986 | Kobayashi et al. | 364/431.05 |
| 4,707,985 | 11/1987 | Nagai et al. | 60/274 |

FOREIGN PATENT DOCUMENTS

| | | |
|---|---|---|
| 52-102934 | 8/1977 | Japan . |
| 53-103796 | 9/1978 | Japan . |
| 55-37562 | 3/1980 | Japan . |
| 57-32772 | 7/1982 | Japan . |
| 57-32773 | 7/1982 | Japan . |
| 57-32774 | 7/1982 | Japan . |
| 58-27848 | 2/1983 | Japan . |
| 58-48755 | 3/1983 | Japan . |
| 58-48756 | 3/1983 | Japan . |
| 58-53661 | 3/1983 | Japan . |
| 58-72646 | 4/1983 | Japan . |
| 58-72647 | 4/1983 | Japan . |
| 58-135343 | 8/1983 | Japan . |
| 58-150038 | 9/1983 | Japan . |
| 58-150039 | 9/1983 | Japan . |
| 58-152147 | 9/1983 | Japan . |
| 59-32644 | 2/1984 | Japan . |
| 59-206638 | 11/1984 | Japan . |
| 60-1340 | 1/1985 | Japan . |
| 60-26138 | 2/1985 | Japan . |
| 60-53635 | 3/1985 | Japan . |
| 61-34330 | 2/1986 | Japan . |
| 61-53436 | 3/1986 | Japan . |

*Primary Examiner*—Andrew M. Dolinar
*Attorney, Agent, or Firm*—Oliff & Berridge

[57] ABSTRACT

In a double air-fuel ratio sensor system including two air-fuel ratio sensors, upstream and downstream of a catalyst converter provided in an exhaust gas passage, a skip amount is calculated in accordance with the output of the downstream-side air-fuel ratio sensor, and a skip operation is performed upon an air-fuel ratio correction amount FAF by the skip amount when the output of the upstream-side air-fuel ratio sensor is switched from the rich side to the lean side, or vice versa. When the skip amount is larger than a predetermined value, the skip amount is divided into a plurality of amounts, thus enabling a plurality of skip operations to be performed upon the air-fuel ratio correction amount FAF.

8 Claims, 8 Drawing Sheets

FIRST FEEDBACK ROUTINE
F/B ?
NO
YES
301
FETCH V1
302
V1 ≦ VR1 ?
303
NO (RICH)
YES (LEAN)
F = "1" ?
304
NO (NOT SWITCHED)
YES (SWITCHED)
RSR > A ?
305
NO
YES
B ← RSR − A
306
FAF ← FAF + A
307
CINJ ≧ Co ?
309
NO
YES
FAF ← FAF + RSR
310
FAF ← FAF+RSR−B
311
B ← 0
312
CINJ = Co ?
313
YES
NO
FAF ← FAF + KIR
314
B = 0 ?
315
YES
FAF ← FAF + B
316
B ← 0
317
CINJ ← 0
308
F ← "0"
318
RETURN
334

DOUBLE AIR-FUEL RATIO SENSOR SYSTEM HAVING DIVIDED-SKIP FUNCTION

BACKGROUND OF THE INVENTION

1. Field of the Invention

The present invention relates to a method and apparatus for feedback control of an air-fuel ratio in an internal combustion engine having two air-fuel ratio sensors upstream and downstream of a catalyst converter disposed within an exhaust gas passage.

2. Description of the Related Art

Generally, in a feedback control of the air-fuel ratio in a single air-fuel ratio sensor ($O_2$ sensor) system, a base fuel amount TAUP is calculated in accordance with the detected intake air amount and detected engine speed, and the base fuel amount TAUP is corrected by an air-fuel ratio correction coefficient FAF which is calculated in accordance with the output signal of an air-fuel ratio sensor (for example, an $O_2$ sensor) for detecting the concentration of a specific component such as the oxygen component in the exhaust gas. Thus, an actual fuel amount is controlled in accordance with the corrected fuel amount. The above-mentioned process is repeated so that the air-fuel ratio of the engine is brought close to a stoichiometric air-fuel ratio. According to this feedback control, the center of the controlled air-fuel ratio can be within a very small range of air-fuel ratios around the stoichiometric ratio required for three-way reducing and oxidizing catalysts (catalyst converter) which can remove three pollutants CO, HC and $NO_x$ simultaneously from the exhaust gas.

In the above-mentioned $O_2$ sensor system where the $O_2$ sensor is disposed at a location near the concentration portion of an exhaust manifold, i.e., upstream of the catalyst converter, the accuracy of the controlled air-fuel ratio is affected by individual differences in the characteristics of the part of the engine, such as the $O_2$ sensor, the fuel injection valves, the exhaust gas recirculation (EGR) valve, the valve lifters, individual changes due to the aging of these parts, environmental changes, and the like. That is, if the characteristics of the $O_2$ sensor fluctuate, or if the uniformity of the exhaust gas fluctuates, the accuracy of the air-fuel ratio feedback correction amount FAF is also fluctuated, thereby causing fluctuations in the controlled air-fuel ratio.

Compensation for the fluctuation of the controlled air-fuel ratio, double $O_2$ sensor systems is known. Namely, in a double $O_2$ sensor system another $O_2$ sensor is provided downstream of the catalyst converter, and thus an air-fuel ratio control operation is carried out by the downstream-side $O_2$ sensor is addition to an air-fuel ratio control operation carried out by the upstream-side $O_2$ sensor. In the double $O_2$ sensor system, although the downstream-side $O_2$ sensor has lower response speed characteristics when compared with the upstream-side $O_2$ sensor, the downstream-side $O_2$ sensor has an advantage in that the output fluctuation characteristics are small when compared with those of the upstream-side $O_2$ sensor, for the following reasons:

(1) On the downstream side of the catalyst converter, the temperature of the exhaust gas is low, so that the downstream-side $O_2$ sensor is not affected by a high temperature exhaust gas.

(2) On the downstream side of the catalyst converter, although various kinds of pollutants are trapped in the catalyst converter, these pollutants have little affect on the downstream side $O_2$ sensor.

(3) On the downstream side of the catalyst converter, the exhaust gas is mixed so that the concentration of oxygen in the exhaust gas is approximately in an equilibrium state.

Therefore, according to the double $O_2$ sensor system, the fluctuation of the output of the upstream-side $O_2$ sensor is compensated for by a feedback control using the output of the downstream-side $O_2$ sensor. Actually, as illustrated in FIG. 1, in the worst case, the deterioration of the output characteristics of the $O_2$ sensor in a single $O_2$ sensor system directly effects a deterioration in the emission characteristics. On the other hand, in a double $O_2$ sensor system, even when the output characteristics of the upstream-side $O_2$ sensor are deteriorated, the emission characteristics are not deteriorated. That is, in a double $O_2$ sensor system, even if only the output characteristics of the downstream-side $O_2$ are stable, good emission characteristics are still obtained.

In the above-mentioned double $O_2$ sensor system, for example, an air-fuel ratio feedback control parameter such as a rich skip amount RSR and/or a lean skip amount RSL is calculated in accordance with the output of the downstream-side $O_2$ sensor, and an air-fuel ratio correction amount FAF is calculated in accordance with the output of the upstream-side $O_2$ sensor and the air-fuel ratio feedback control parameter (see: U.S. Pat. No. 4,693,076). In this case, the skip amounts RSR and RSL are guarded by a maximum value such as 10%, which ensures that the drivability will not be deteriorated by the fluctuation of the air-fuel ratio. As a result, when the upstream-side $O_2$ sensor has deteriorated so that the controlled center thereof is greatly shifted, it is impossible to accurately control the stoichiometric air-fuel ratio. For this purpose, to avoid surging, when the upstream-side $O_2$ sensor has deteriorated so that the controlled center thereof is greatly shifted, and the skip amount RSR or RSL exceeds the maximum value, the delay time periods TDR and TDL are changed to further move the air-fuel ratio to the rich side or lean side, and thus surging is avoided (see FIGS. 11 and 12 of U.S. Pat. No. 4,693,076).

In the above-mentioned double $O_2$ sensor system, however, when the skip amount RSR or RSL exceeds the maximum value, the delay time periods TDR and TDL are changed to increase the difference therebetween, thus reducing the feedback control frequency, i.e., the response characteristics. Also, in view of the control characteristics of the engine, the delay time periods TDR and TDL should not be changed, since their optimum values are dependent upon the engine load.

SUMMARY OF THE INVENTION

It is an object of the present invention to provide a double air-fuel ratio ($O_2$ ) sensor system in which the drivability and response speed are not deteriorated even when the upstream-side air-fuel ratio sensor is greatly deteriorated.

According to the present invention, in a double air-fuel ratio sensor system including two air-fuel ratio sensors, upstream and downstream of a catalyst converter provided in an exhaust gas passage, a skip amount is calculated in accordance with an output of the downstream-side air-fuel ratio sensor, and a skip operation is performed upon an air-fuel ratio correction amount FAF by the skip amount when the output of the upstream-side air-fuel ratio sensor is switched from the rich side to the lean side, or vice versa. When the skip amount is larger than a predetermined value, the skip amount is divided into a plurality of amounts, and thus a plurality of skip operations are performed upon the air-fuel ratio correction amount FAF. As a result, when the upstream-side air-fuel ratio sensor has deteriorated so that the controlled center thereof is greatly shifted, it is still possible to carry out a control for the stoichiometric air-fuel ratio. Also, since the fluctuation of the air-fuel ratio correction amount FAF is small, the fluctuation of torque is also small, and thus the drivability is not affected.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Figure 1:
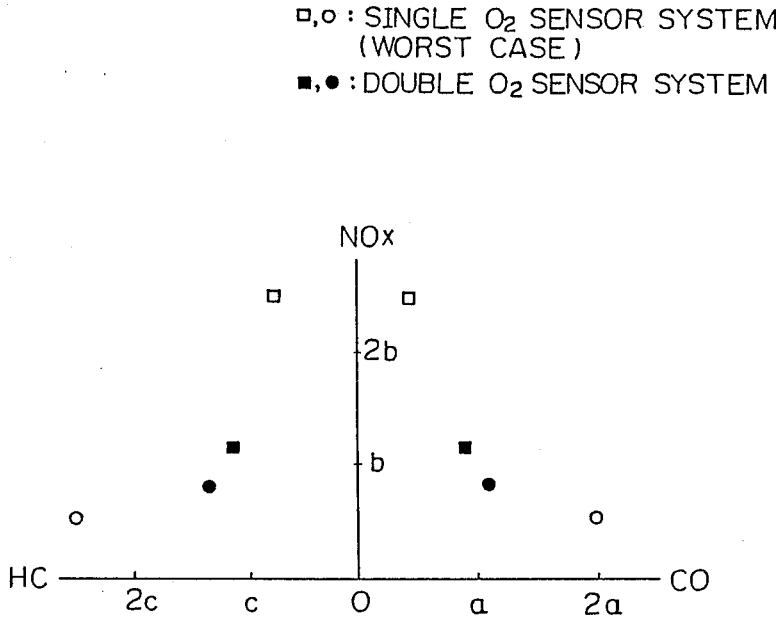
FIG. 1 is a graph showing the emission characteristics of a single $O_2$ sensor system and a double $O_2$ sensor system.
Figure 2:
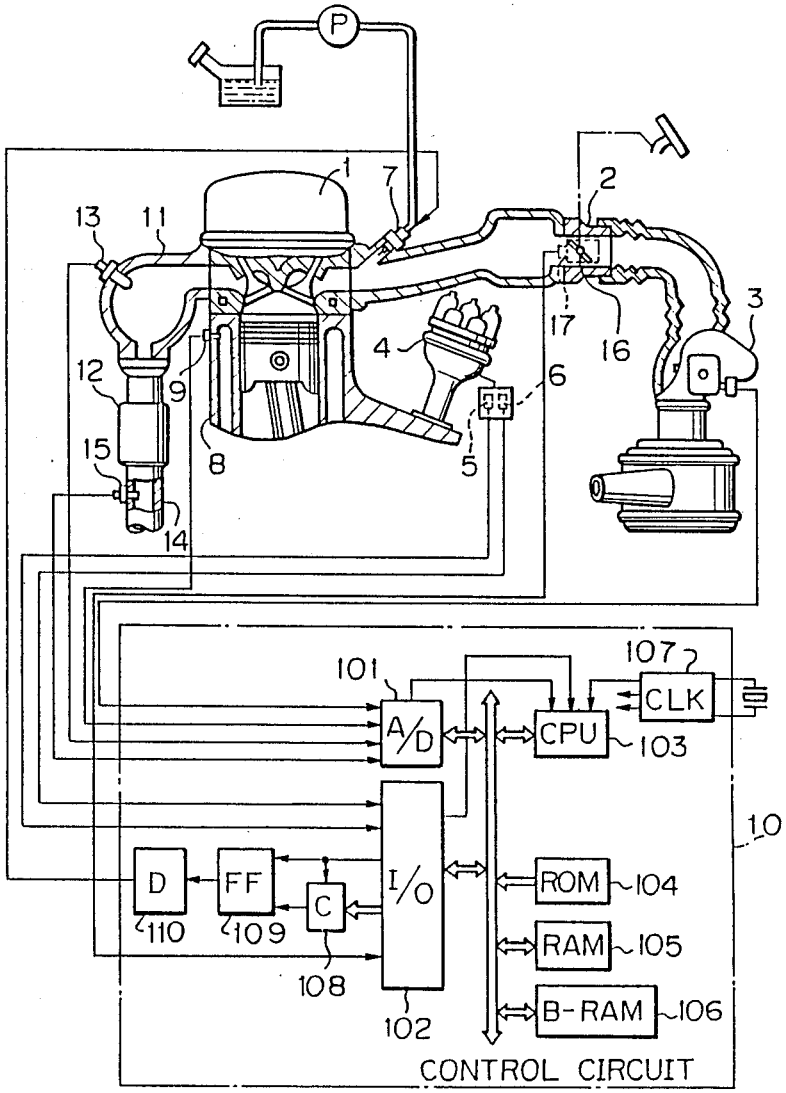
FIG. 2 is a schematic view of an internal combustion engine according to the present invention.

In FIG. 2, which illustrated an internal combustion engine according to the present invention, reference numeral 1 designates a four-cycle spark ignition engine disposed in an automotive vehicle. Provided in an air-intake passage 2 of the engine 1 is a potentiometer-type airflow meter 3 for detecting the amount of air drawn into the engine 1 to generate an analog voltage signal in proportion to the amount of air flowing therethrough. The signal of the airflow meter 3 is transmitted to a multiplexer-incorporating analog-to-digital (A/D) converter 101 of a control circuit 10.

Disposed in a distributor 4 are crank angle sensors 5 and 6 for detecting the angle of the crankshaft (not shown) of the engine 1.

In this case, the crank angle sensor 5 generates a pulse signal at every 720° crank angle (CA) and the crank-angle sensor 6 generates a pulse signal at every 30° CA. The pulse signals of the crank angle sensors 5 and 6 are supplied to an input/output (I/O) interface 102 of the control circuit 10. In addition, the pulse signal of the crank angle sensor 6 is then supplied to an interruption terminal of a central processing unit (CPU) 103.

Additionally provided in the air-intake passage 2 is a fuel injection valve 7 for supplying pressurized fuel from the fuel system to the air-intake port of the cylinder of the engine 1. In this case, other fuel injection valves are also provided for other cylinders, but are not shown in FIG. 2.

Disposed in a cylinder block 8 of the engine 1 is a coolant temperature sensor 9 for detecting the temperature of the coolant. The coolant temperature sensor 9 generates an analog voltage signal in response to the temperature THW of the coolant and transmits that signal to the A/D converter 101 of the control circuit 10.

Provided in an exhaust system on the downstream-side of an exhaust manifold 11 is a three-way reducing and oxidizing catalyst converter 12 which removes three pollutants CO, HC and $NO_x$ simultaneously from the exhaust gas.

Provided on the concentration portion of the exhaust manifold 11, i.e., upstream of the catalyst converter 12, is a first $O_2$ sensor 13 for detecting the concentration of oxygen composition in the exhaust gas. Further, provided in an exhaust pipe 14 downstream of the catalyst converter 12 is a second $O_2$ sensor 15 for detecting the concentration of oxygen composition in the exhaust gas. The $O_2$ sensors 13 and 15 generate output voltage signals and transmit those signals to the A/D converter 101 of the control circuit 10.

Reference 16 designates a throttle valve, and 17 an idle switch for detecting whether or not the throttle valve 16 is completely closed.

The control circuit 10, which may be constructed by a microcomputer, further comprises a central processing unit (CPU) 103, a read-only memory (ROM) 104 for storing a main routine and interrupt routines such as a fuel injection routine, an ignition timing routine, tables (maps), constants, etc., a random access memory 105 (RAM) for storing temporary data, a backup RAM 106, a clock generator 107 for generating various clock signals, a down counter 108, a flip-flop 109, a driver circuit 110, and the like.

Note that the battery (not shown) is connected directly to the backup RAM 106 and, therefore, the content thereof is not erased even when the ignition switch (not shown) is turned OFF.

The down counter 108, the flip-flop 109, and the driver circuit 110 are used for controlling the fuel injection valve 7. That is, when a fuel injection amount TAU is calculated in a TAU routine, which will be later explained, the amount TAU is preset in the down counter 108, and simultaneously, the flip-flop 109 is set. As a result, the driver circuit 110 initiates the activation of the fuel injection valve 7. On the other hand, the down counter 108 counts up the clock signal from the clock generator 107, and finally generates a logic "1" signal from the carry-out terminal of the down counter 108, to reset the flip-flop 109, so that the driver circuit 110 stops the activation of the fuel injection valve 7. Thus, the amount of fuel corresponding to the fuel injection amount TAU is injected into the fuel injection valve 7.

Interruptions occur at the CPU 103 when the A/D converter 101 completes an A/D conversion and generates an interrupt signal; when the crank angle sensor 6 generates a pulse signal; and when the clock generator 107 generates a special clock signal.

The intake air amount data Q of the airflow meter 3 and the coolant temperature data THW of the coolant sensor 9 are fetched by an A/D conversion routine(s) executed at every predetermined time period and are then stored in the RAM 105. That is, the data Q and THW in the RAM 105 are renewed at predetermined time periods. The engine speed Ne is calculated by an interrupt routine executed at 30° CA, i.e., at every pulse signal of the crank angle sensor 6, and is then stored in the RAM 105.

The operation of the control circuit 10 of FIG. 2 will be now explained.

Figures 3, 3A, 3B:
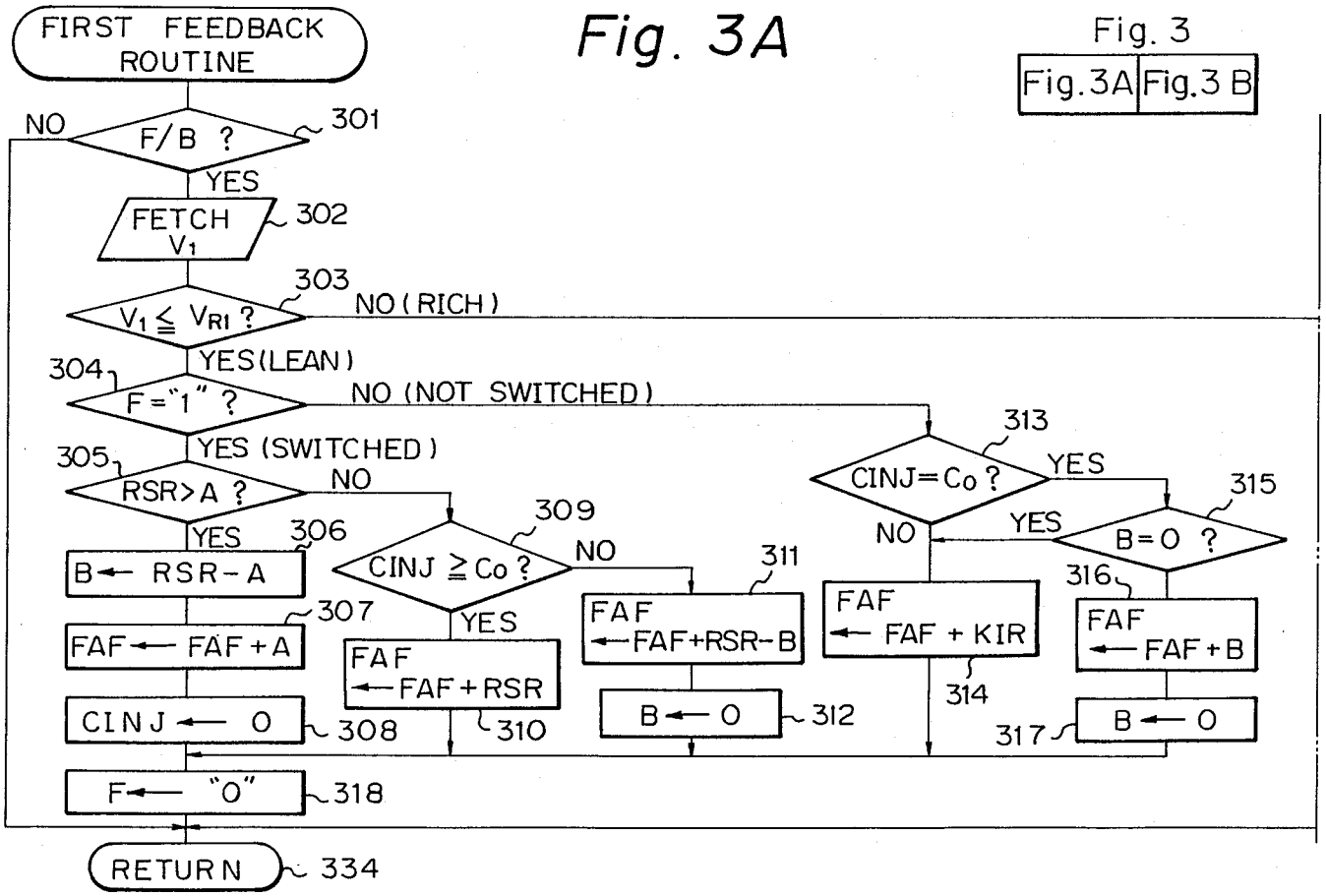
FIGS. 3, 3A, 3B, 5, and 6 are flow charts showing the operation of the control circuit of FIG. 2.
Figure 3B:
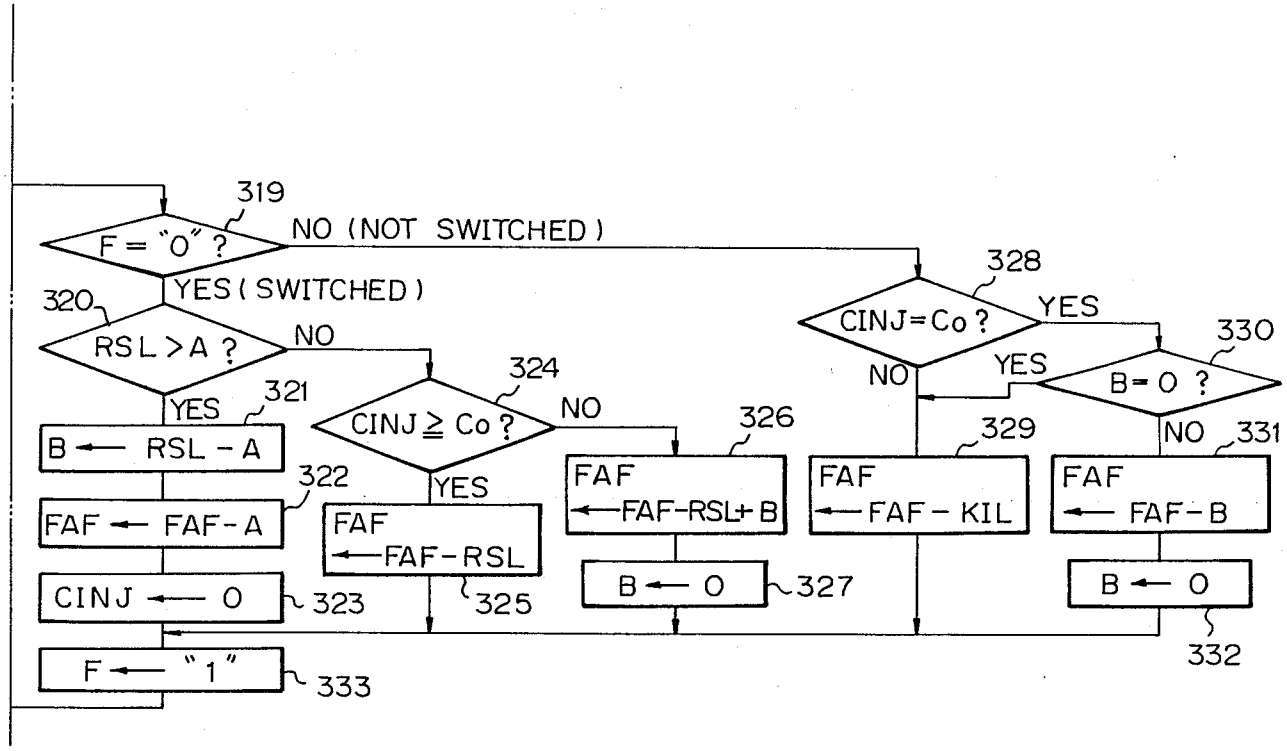

FIG. 3 is a routine for calculating an air-fuel ratio correction amount FAF in accordance with the output of the upstream-side $O_2$ sensor 13 executed at every predetermined time period such as 4 ms.

At step 301, it is determined whether or not all of the feedback control (closed-loop control) conditions by the upstream-side $O_2$ sensor 13 are satisfied. The feedback control conditions are as follows:

(i) the engine is not in a fuel cut-off state;
(ii) the engine is not in a starting state;
(iii) the coolant temperature THW is higher than 60° C.;
(iv) the power fuel incremental amount FPOWER is 0; and
(v) the upstream-side $O_2$ sensor 13 is in an activated state.

Note that the determination of activation/nonactivation of the upstream-side $O_2$ sensor 13 is carried out by determining whether or not the coolant temperature THW≧60° C., or by whether or not the output of the upstream-side $O_2$ sensor 13 is once swung, i.e., once changed from the rich side to the lean side, or vice versa. Of course, other feedback control conditions are introduced as occasion demands. However, an explanation of such other feedback control conditions is omitted.

If one or more of the feedback control conditions are not satisfied, the control proceeds directly to step 334, thereby carrying out an open-loop control operation. Note that, in this open-loop control operation, the amount FAF can be a definite value such as 1.0 or a value of a mean value immediately before the open-loop control operation. That is, the amount FAF or a mean value FAF thereof is stored in the backup RAM 106, and in an open-loop control operation, the value FAF or FAF is read out of the backup RAM 106.

Contrary to the above, at step 301, if all of the feedback control conditions are satisfied, the control proceeds to step 302.

At step 302, an A/D conversion is performed upon the output voltage $V_1$ of the upstream-side $O_2$ sensor 13, and the A/D converted value thereof is then fetched from the A/D converter 101. Then at step 303, the voltage $V_1$ is compared with a reference voltage $V_{R1}$ such as 0.45 V, thereby determining whether the current air-fuel ratio detected by the upstream-side $O_2$ sensor 13 is on the rich side or on the lean side with respect to the stoichiometric air-fuel ratio. As a result, if $V_1 \leqq V_{R1}$, which means that the current air-fuel ratio is lean, the control proceeds to steps 304 to 318. Otherwise, if ($V_1 > V_{R1}$), the control proceeds to steps 319 to 332.

At step 304, it is determined whether or not the air-fuel ratio determined by the upstream-side $O_2$ sensor 13 is switched from the rich side to the lean side. That is, it is determined whether or not an air-fuel ratio flag F showing the air-fuel ratio immediately before the execution of this routine is "1" (rich). If the air-fuel ratio is switched from the rich side to the lean side, the control proceeds to steps 305 to 312, which carry out an rich skip operation. On the other hand, if the ratio is not switched, the control proceeds to steps 313 to 317 which carry out a rich integration operation partly including a rich skip operation.

Figure 5:
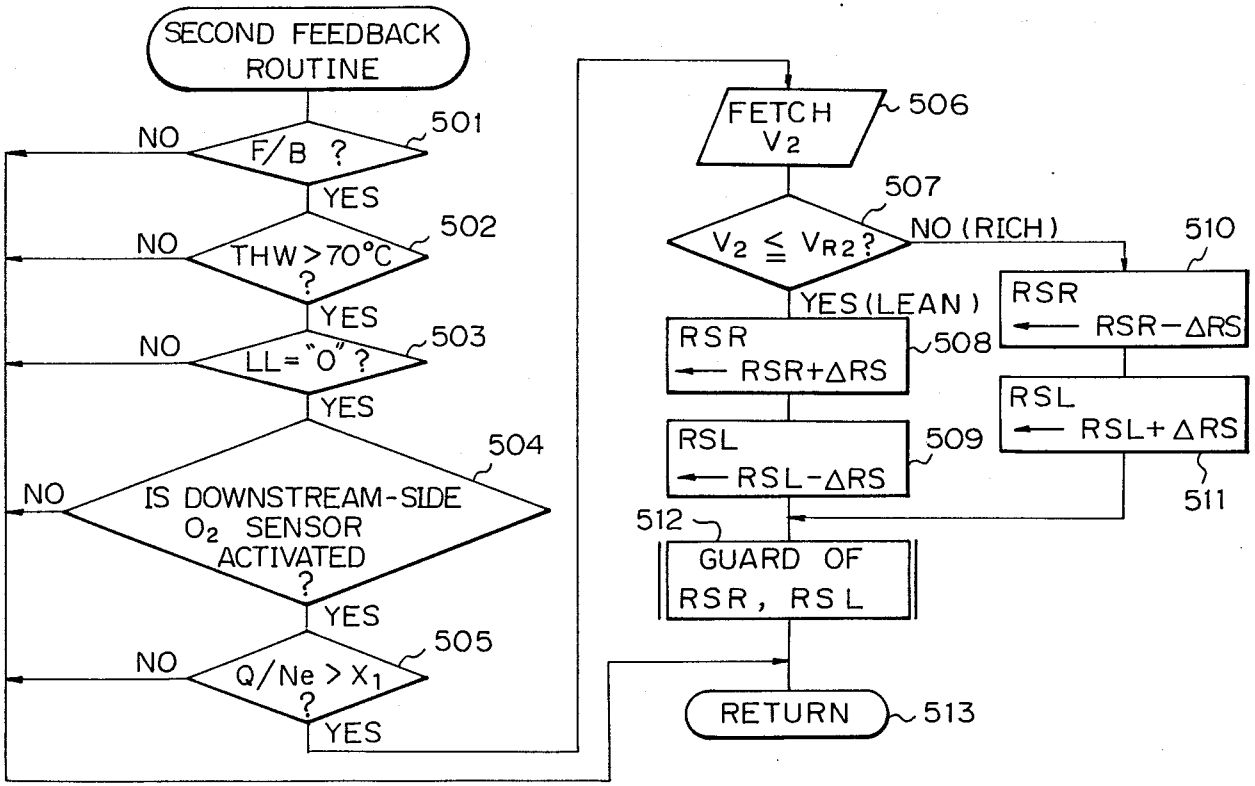

The rich skip operation will be now explained. At step 305, a rich skip amount RSR, which is calculated by a routine of FIG. 5, is compared with a predetermined value A by which torque fluctuation is permitted. As a result, if RSR>A, the control proceeds to steps 306 to 308 which divide the rich skip amount RSR into a first amount A and a second amount B (=RSR−A), and in this case, skip up the air-fuel ratio correction amount FAF by the first amount A. Namely, the second amount B is calculated at step 306, and at step 307, a skip operation of the first amount A is carried out, then at step 308, a counter CINJ is cleared in order to prepare a skip operation of the second amount B. Note that the counter CINJ is used for counting the number of fuel injections, and when CINJ reaches Co, a skip operation of the second amount B is carried out at step 316 in the midst of a rich integration operation. On the other hand, if RSR≦A at step 305, the control proceeds to steps 309 and 310 which skip up the air-fuel ratio correction amount FAF by the rich skip amount RSR at one time. Note that steps 311 and 312 are used for carrying out a rich skip operation for correcting the non-executed second amount B in the previous lean skip operation when CINJ<Co. Also, steps 311 and 312 are effective only when B=0.

The rich integration operation will be explained. At step 313, it is determined whether or not CINJ has reached Co. As a result, if CINJ=Co, the control proceeds to step 314 which gradually increases the air-fuel ratio correction amount FAF by a rich integration amount KIR which is smaller than the skip amount RSR (RSL). On the other hand, if CINJ−Co, the control proceeds to steps 315, 316, and 317 which skip up the air-fuel ratio correction amount FAF by the second amount B. Note that this skip operation is effective only when B=0.

Then, the control proceeds to step 318, which resets the air-fuel ratio flag F, i.e., F is caused to be "0" (lean), and this routine is then completed by step 334.

Similarly, at step 319, it is determined whether or not the air-fuel ratio determined by the upstream-side $O_2$ sensor 13 is switched from the lean side to the rich side. That is, it is determined whether or not an air-fuel ratio flag F showing the air-fuel ratio immediately before the execution of this routine is "0" (lean). If the air-fuel ratio is switched from the lean side to the rich side, the control proceeds to steps 320 to 327 which carry out a lean skip operation. On the other hand, if the ratio is not switched, the control proceeds to steps 328 to 332 which carry out a lean integration operation partly including a lean skip operation.

The lean skip operation will be now explained. AT step 419, a lean skip amount RSL, which is calculated by the routine of FIG. 5, is compared with the predetermined value A. As a result, if RSL>A, the control proceeds to steps 321 to 323 which divide the lean skip amount RSL into a first amount A and a second amount B (=RSL−A), and in this case, skip down the air-fuel ratio correction amount FAF by the first amount A. That is, the second amount B is calculated at step 321, and at step 322, a skip operation of the first amount A is carried out, then at step 323, the counter CINJ is cleared in order to prepare a skip operation of the second amount B. Note that, when CINJ reaches Co, a skip operation of the second amount B is carried out at step 331 in the midst of a lean integration operation. On the other hand, if RSL≦A at step 320, the control proceeds to steps 324 and 325 which skip down the air-fuel ratio correction amount FAF by the lean skip amount RSL at one time. Note that steps 326 and 327 are used for carrying out a lean skip operation for correcting the non-executed second amount B in the previous rich skip operation when CINJ<Co. Also, steps 326 and 327 are effective only when B=0.

The lean integration operation will be explained. At step 328, it is determined whether or not CINJ has reached Co. As a result, if CINJ=Co, the control proceeds to step 320 which gradually decreases the air-fuel ratio correction amount FAF by a lean integration amount KIL which is smaller than the skip amount RSR (RSL). On the other hand, if CINJ=Co, the control proceeds to steps 330, 331, and 332 which skip down the air-fuel ratio correction amount FAF by the second amount B. Note that this skip operation is effective only when B=0.

Then, the control proceeds to step 333 which sets the air-fuel ratio flag F, i.e., F is caused to be "1" (rich), and the routine is completed by step 334.

Figures 4A, 4B, 4C:
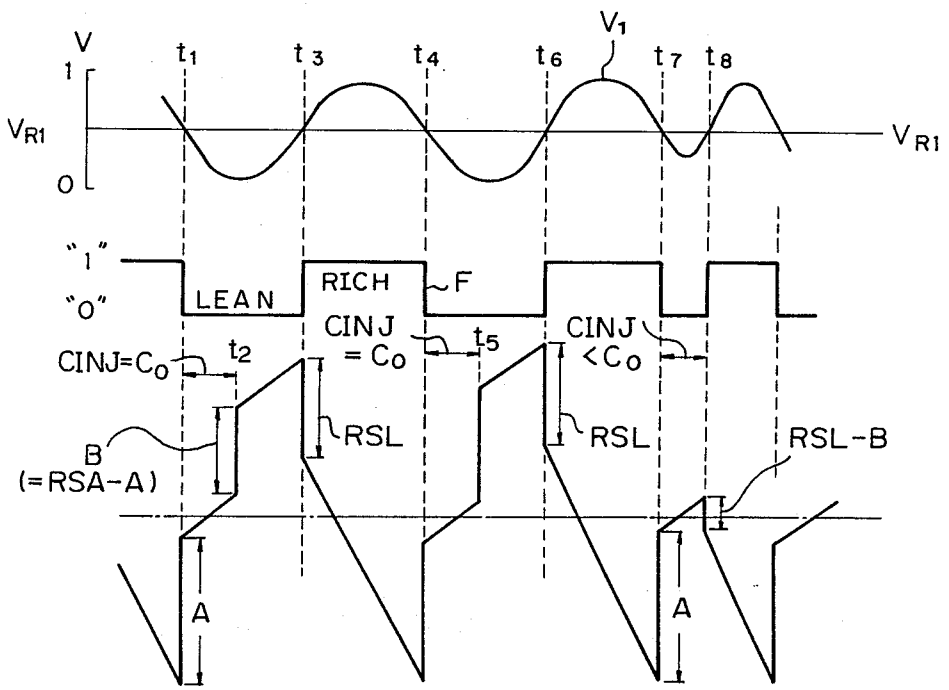
FIGS. 4A, 4B, and 4C are timing diagrams explaining the flow chart of FIG. 3.

The operation of the flow chart of FIG. 3 will be explained with reference to FIGS. 4A, 4B, and 4C. When the output $V_1$ of the upstream-side $O_2$ sensor 13 is changed as illustrated in FIG. 5A, the air-fuel ratio flag F is changed as illustrated in FIG. 5B. Here, assume that RSR<A and RSL≦A, then in this case, at time $t_1$, $t_4$, and $t_7$, the air-fuel ratio flag F is switched from the rich side ("1") to the lean side ("0"), and accordingly, the air-fuel ratio correction amount RSR is skipped up by the first amount A at step 307 of FIG. 3. Then, at times $t_2$ and $t_5$, the air-fuel ratio correction amount FAF is skipped by the second amount B at step 316 of FIG. 3. On the other hand, at times $t_3$ and $t_6$, the air-fuel ratio flag F is switched from the lean side ("0") to the rich side ("1"). In this case, since RSL≦A, the air-fuel ratio correction amount FAF is skipped down by the lean skip amount RSL at one time at step 325 of FIG. 3. Also, at time $t_8$, since the air-fuel ratio flag F is again switched from the lean side ("0") to the rich side ("1") before a predetermined period has passed (CINJ<Co) after the switching of the air-fuel ratio flag F from the rich side ("1") to the lean side ("0"), the lean skip amount RSL is replaced by RSL−B in view of the non-executed second rich skip amount B, thus carrying out a lean skip operation.

FIG. 5 is a routine for calculating skip amounts RSR and RSL in accordance with the output of the downstream-side $O_2$ sensor 15 executed at every predetermined time period such as 1 s.

As steps 501 through 505, it is determined whether or not all of the feedback control (closed-loop control) conditions by the downstream-side $O_2$ sensor 15 are satisfied. For example, at step 501, it is determined whether or not the feedback control conditions by the upstream-side $O_2$ sensor 13 are satisfied. At step 502, it is determined whether or not the coolant temperature THW is higher than 70° C. At step 503, it is determined whether or not the throttle valve 16 is open (LL="0"). At step 504, it is determined whether or not the output $V_2$ of the downstream-side $O_2$ sensor 15 has been once changed from the lean side to the rich side or vice versa. At step 505, it is determined whether or not a load parameter such as Q/Ne is larger than a predetermined value $X_1$. Of course, other feedback control conditions are introduced as occasion demands. For example, a condition whether or not the secondary air suction system is driven when the engine is in a deceleration state. However, an explanation of such other feedback control conditions is omitted.

If one or more of the feedback control conditions is not satisfied, the control directly proceeds to step 513, thereby carrying out an open-loop control operation.

Contrary to the above, if all of the feedback control conditions are satisfied, the control proceeds to steps 506 to 512, which carry out a substantial air-fuel ratio feedback control by the downstream-side $O_2$ sensor 15.

That is, at step 506, an A/D conversion is performed upon the output voltage $V_2$ of the downstream-side $O_2$ sensor 15, and the A/D converted value thereof is then fetched from the A/D converter 101. Then, at step 507, the voltage $V_2$ is compared with a reference voltage $V_{R2}$ such as 0.55 V, thereby determining whether the current air-fuel ratio detected by the downstream-side $O_2$ sensor 15 is on the rich side or on the lean side with respect to the stoichiometric air-fuel ratio. Note that the reference voltage $V_{R2}$ (=0.55 V) is preferably higher than the reference voltage $V_{R1}$ (=0.45 V), in consideration of the difference in output characteristics and deterioration speed between the $O_2$ sensor 13 upstream of the catalyst converter 12 and the $O_2$ sensor 15 downstream of the catalyst converter 12. However, the volta $V_{R2}$ can be voluntarily determined.

At step 507, if the air-fuel ratio upstream of the catalyst converter 12 is lean, the control proceeds to steps 508 and 509. Alternatively, the control proceeds to steps 510 and 511.

At step 508, the rich skip amount RSR is increased by ΔRS to move the air-fuel ratio to the rich side. Further, at step 509, the lean skip amount RSL is decreased by ΔRS to move the air-fuel ratio to the rich side.

On the other hand, at step 510, the rich skip amount ΔSR is decreased by ΔRS to move the air-fuel ratio to the lean side. Further, at step 511, the lean skip amount RSL is increased by ΔRS to move the air-fuel ratio to the lean side.

At step 512, the skip amounts RSR and RSL are guarded by a minimum value MIN and a maximum value MAX. Note that the minimum value MIN is a level by which the transient characteristics of the skip operation using the amounts RSR and RSL can be maintained, and the maximum value MAX is a level by which the drivability is not deteriorated by the fluctuation of the air-fuel ratio. According to the present invention, since the skip amount is divided into two amounts when the skip amount is larger than A, the maximum value MAX can be considerably large, for example, 12%, thus enlarging the scope of the controlled air-fuel ratio.

The skip amounts RSR and RSL are then stored in the RAM 105 or the backup RAM 106, thus completing this routine of FIG. 5 at step 513.

Figure 6:
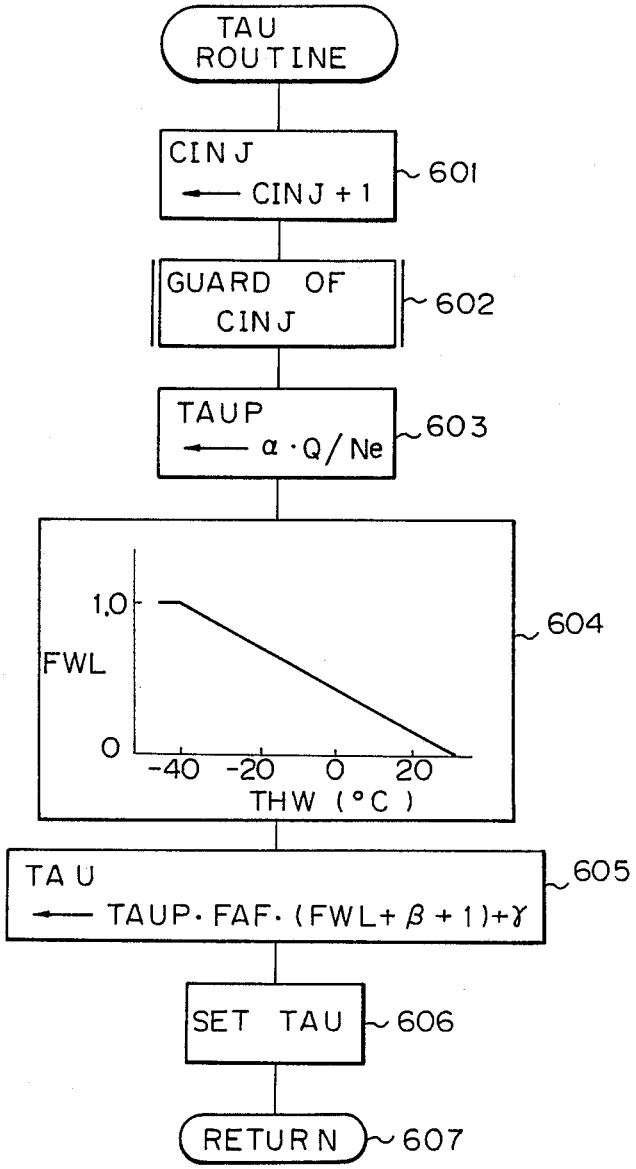

FIG. 6 is a routine for calculating a fuel injection amount TAU executed at every predetermined crank angle such as 360° CA. At step 601, the injection counter CINJ is counted up by +1, and at 6O2 , the value thereof is guarded by a maximum value. Then, at step 603, a base fuel injection amount TAUP is calculated by using the intake air amount data Q and the engine speed data Ne stored in the RAM 105. That is, $$TAUP \leftarrow \alpha \cdot Q/Ne$$

where α is a constant. Then at step 604, a warming-up incremental amount FWL is calculated from a one-dimensional map by using the coolant temperature data THW stored in RAM 105. Note that the warming-up incremental amount FWL decreased when the coolant temperature THW increases. At step 605, a final fuel injectional amount TAU is calculated by $$TAU \leftarrow TAUP \cdot FAF \cdot (FWL + \beta) + \gamma$$

where $\beta$ and $\gamma$ are correction factors determined by other parameters such as the voltage of the battery and the temperature of the intake air. At step 606, the final fuel injection amount TAU is set in the down counter 108, and in addition, the flip-flop 109 is set to initiate the activation of the fuel injection valve 7. This routine is then completed by step 607. Note that, as explained above, when a time period corresponding to the amount TAU has passed, the flip-flop 109 is reset by the carry-out signal of the down counter 108 to stop the activation of the fuel injection valve 7.

Note that, when the skip amount RSR (RSL) is larger than the predetermined value A, it is possible to divide the skip amount into three or more amounts, thus carrying out three or more skip operations, for one switching of the output $V_1$ of the upstream-side $O_2$ sensor 13. Also, the injection counter CINJ can be counted up at every predetermined time period.

Further, the first air-fuel ratio feedback control by the upstream-side $O_2$ sensor 13 is carried out at every relatively small time period, such as 4 ms, and the second air-fuel ratio feedback control by the downstream-side $O_2$ sensor 15 is carried out at every relatively large time period, such as 1 s. This is because the upstream-side $O_2$ sensor 13 has good response characteristics when compared with the downstream-side $O_2$ sensor 15.

Still further, a Karman vortex sensor, a heat-wire type flow sensor, and the like can be used instead of the airflow meter.

Although in the above-mentioned embodiments, a fuel injection amount is calculated on the basis of the intake air amount and the engine speed, it can be also calculated on the basis of the intake air pressure and the engine speed, or the throttle opening and the engine speed.

Further, the present invention can be also applied to a carburetor type internal combustion engine in which the air-fuel ratio is controlled by an electric air control value (EACV) for adjusting the intake air amount; by an electric bleed air control valve for adjusting the air bleed amount supplied to a main passage and a slow passage; or by adjusting the secondary air amount introduced into the exhaust system. In this case, the base fuel injection amount corresponding to TAUP at step 603 of FIG. 6 is determined by the carburetor itself, i.e., the intake air negative pressure and the engine speed, and the air amount corresponding to TAU at step 606 of FIG. 6.

Further, a CO sensor, a lean-mixture sensor or the like can be also used instead of the $O_2$ sensor.

Figure 7:
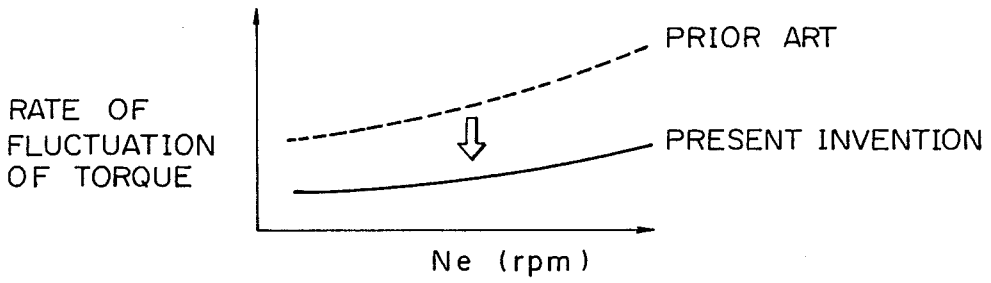
FIG. 7 is a graph explaining the effect of the present invention.

As explained above, according to the present invention, when the skip amount RSR (RSL) is larger than the predetermined value A which corresponds to a skip amount by which the torque fluctuation is not increased, the skip amount RSR (RSL) is divided into two or more amounts, thus reducing the torque fluctuation as illustrated in FIG. 7, whereby the drivability and response characteristics are also improved.

I claim:

1. A method for controlling the air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter for detecting a concentration of a specific component in an exhaust gas, comprising the steps of:

gradually changing an air-fuel ratio correction amount in accordance with the output of said upstream-side air-fuel ratio sensor;

calculating a skip amount in accordance with the output of said downstream-side air-fuel ratio sensor;

shifting said air-fuel ratio correction amount by said skip amount when the output of said upstream-side air-fuel ratio sensor is switched from the rich side to the lean side or vice versa; and adjusting an actual air-fuel ratio of said engine in accordance with said air-fuel ratio correction amount, said shifting step comprising the steps of:

determining whether or not said skip amount is larger than a predetermined value;

performing one skip operation upon said air-fuel ratio correction amount by said skip amount when said skip amount is not larger than said predetermined value; and performing a plurality of skip operations upon said air-fuel ratio correction amount by dividing said skip amount into a plurality of amounts when said skip amount is larger than said predetermined value.

2. A method as set forth in claim 1, wherein said plurality of skip operations performing step comprises the steps of:

calculating a difference between said skip amount and said predetermined value;

shifting said air-fuel ratio correction amount by said predetermined value after the output of said upstream-side air-fuel ratio sensor is switched; and shifting said air-fuel ratio correction amount by said difference after a predetermined period has passed after the switching of the output of said upstream-side air-fuel ratio sensor.

3. A method as set forth in claim 1, wherein said gradually-changing step comprises the steps of:

gradually increasing said air-fuel ratio correction amount when the output of said upstream-side air-fuel ratio sensor is on the lean side; and gradually decreasing said air-fuel ratio correction amount when the output of said upstream-side air-fuel ratio sensor is on the rich side.

4. A method as set forth in claim 1, wherein said skip amount includes a rich skip amount and a lean skip amount, and said shifting step comprises the steps of:

shifting up said air-fuel ratio correction amount by said skip amount when the output of said upstream-side air-fuel ratio sensor is switched from the rich side to the lean side; and shifting down said air-fuel ratio correction amount by said lean skip amount when the output of said upstream-side air-fuel ratio sensor is switched from the lean side to the rich side.

5. An apparatus for controlling the air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter for detecting a concentration of a specific component in an exhaust gas, comprising:

means for gradually changing an air-fuel ratio correction amount in accordance with the output of said upstream-side air-fuel ratio sensor;

means for calculating a skip amount in accordance with the output of said downstream-side air-fuel ratio sensor;

means for shifting said air fuel ratio correction amount by said skip amount when the output of said upstream-side air-fuel ratio sensor is switched from the rich side to the lean side or vice versa; and means for adjusting an actual air-fuel ratio of said engine in accordance with said air-fuel ratio correction amount, said shifting means comprising:

means for determining whether or not said skip amount is larger than a predetermined value;

means for performing one skip operation upon said air-fuel ratio correction amount by said skip amount when said skip amount is not larger than said predetermined value; and means for performing a plurality of skip operations upon said air-fuel ratio correction amount by dividing said skip amount into a plurality of amounts when said skip amount is larger than said predetermined value.

6. An apparatus as set forth in claim 5, wherein said plurality of skip operations performing means comprises:

means for calculating a difference between said skip amount and said predetermined value;

means for shifting said air-fuel ratio correction amount by said predetermined value after the output of said upstream-side air-fuel ratio sensor is switched; and means for shifting said air-fuel ratio correction amount by said difference after a predetermined period has passed after the switching of the output of said upstream-side air-fuel ratio sensor.

7. An apparatus as set forth in claim 5, wherein said gradually-changing means comprises:

means for gradually increasing said air-fuel ratio correction amount when the output of said upstream-side air-fuel ratio sensor is on the lean side; and means for gradually decreasing said air-fuel ratio correction amount when the output of said upstream-side air-fuel ratio sensor is on the rich side.

8. An apparatus as set forth in claim 5, wherein said skip amount includes a rich skip amount and a lean skip amount, and said shifting means comprises:

means for shifting up said air-fuel ratio correction amount by said skip amount when the output of said upstream-side air-fuel ratio sensor is switched from the rich side to the lean side; and means for shifting down said air-fuel ratio correction amount by said lean skip amount when the output of said upstream-side air-fuel ratio sensor is switched from the lean side to the rich side.

* * * * *